US009093054B2

(12) United States Patent
Werges

(10) Patent No.: US 9,093,054 B2
(45) Date of Patent: Jul. 28, 2015

(54) ERGONOMIC GUITAR STRAP

(71) Applicant: Thomas E. Werges, Los Angeles, CA (US)

(72) Inventor: Thomas E. Werges, Los Angeles, CA (US)

(73) Assignee: Thomas E. Werges, Los Angeles, CA (US)

( * ) Notice: Subject to any disclaimer, the term of this patent is extended or adjusted under 35 U.S.C. 154(b) by 17 days.

(21) Appl. No.: 13/886,784

(22) Filed: May 3, 2013

(65) Prior Publication Data

US 2013/0298747 A1 Nov. 14, 2013

Related U.S. Application Data

(60) Provisional application No. 61/644,694, filed on May 9, 2012.

(51) Int. Cl.
*G10D 3/00* (2006.01)
*G10G 5/00* (2006.01)

(52) U.S. Cl.
CPC ..... *G10G 5/005* (2013.01)

(58) Field of Classification Search
USPC ..... 84/327
See application file for complete search history.

(56) References Cited

U.S. PATENT DOCUMENTS

| | | | | |
|---|---|---|---|---|
| 4,254,901 | A | 3/1981 | McIntosh | |
| 5,332,137 | A * | 7/1994 | Violette | 224/257 |
| 6,199,731 | B1 | 3/2001 | Lehoux | |
| 6,359,203 | B1 | 3/2002 | Cronos | |
| 7,009,097 | B1 * | 3/2006 | Terplivetz | 84/327 |
| 7,375,269 | B2 * | 5/2008 | Perkins | 84/327 |
| 8,536,433 | B1 * | 9/2013 | Foster | 84/327 |
| 2010/0032463 | A1 | 2/2010 | Komura | |

OTHER PUBLICATIONS

International Search Report received from corresponding PCT Application No. PCT/US2013/040344, mailing date Sep. 16, 2013.
Written Opinion received from corresponding PCT Application No. PCT/US2013/040344, mailing date Sep. 16, 2013.

* cited by examiner

*Primary Examiner* — Christopher Uhlir
(74) *Attorney, Agent, or Firm* — LKP Global Law, LLP

(57) ABSTRACT

Various embodiments and methods of using an ergonomic guitar strap are disclosed herein.

9 Claims, 8 Drawing Sheets

ERGONOMIC GUITAR STRAP

CROSS-REFERENCE TO RELATED APPLICATIONS

This application claims the benefit of U.S. Provisional Application No. 61/644,694 filed May 9, 2012, which is hereby incorporated herein by reference in its entirety.

BACKGROUND

A traditional guitar strap has one end affixed to the heel of the guitar and the opposite end affixed to or near the neck of the guitar. The traditional guitar strap is placed over one shoulder and allows a player to displace the weight of the guitar over the player's back and shoulder only in lieu of holding the guitar. While the traditional guitar straps are useful, there still remains a need for a guitar strap that allows a player to play a guitar more comfortably for long periods of time.

SUMMARY

Briefly, and in general terms, various embodiments are directed to an ergonomic guitar strap. In one embodiment, the ergonomic guitar strap includes a waist belt composed of a length of material having a first end and a second end, wherein the first end has a first fastening member and the second end having a second fastening member such that the first fastening member is reversibly coupled to the second fastening member. The ergonomic guitar strap further includes an upper strap composed of a length of material having a first end and a second end, wherein the first end of the upper strap is attached to the waist belt, and wherein the second end of the upper strap includes a strap end adapted to be affixed to a strap button located, on a guitar neck or a guitar body. The ergonomic guitar strap also includes a lower strap composed of a length of material having a first end and a second end, wherein the first end of the heel strap is attached to the waist belt, and wherein the second end includes a strap end adapted to be affixed to a heel strap button located at a base of the guitar body. In this embodiment, the second end of the upper strap is oriented above the waist belt, and the second end of the lower strap is oriented below the waist belt.

In another embodiment, the ergonomic guitar strap includes a waist belt composed of a length of material having a first end and a second end, wherein the first end has a first fastening member and the second end having a second fastening member such that the first fastening member is reversibly coupled to the second fastening member. The ergonomic guitar strap also includes a horn strap composed of a length of material having a first end and a second end, wherein the first end of the horn strap is attached to the waist belt, and wherein the second end of the horn strap includes a strap end adapted to be affixed to a strap button located on a guitar neck or a guitar body. The ergonomic guitar strap further includes a heel strap composed of a length of material having a first end and a second end, wherein the first end of the heel strap is attached to the waist belt, and wherein the second of the heel strap includes a strap end adapted to be affixed to a heel strap button located, at a base of the guitar body. In this embodiment, the second ends of the horn and heel straps are oriented below the waist belt.

In addition to various embodiments of ergonomic guitar straps, various methods are disclosed herein. According to one method, an ergonomic guitar strap is provided having a horn strap and heel, strap attached to a waist belt. The guitar strap is worn around the waist of the player. The heel strap is then attached to a heel button on a base of the guitar. The horn strap is attached to a lower horn button provided on a lower horn of the guitar.

Other features and advantages will become apparent from the following detailed description, taken in conjunction with the accompanying drawings, which illustrate by way of example, the features of the various embodiments.

DETAILED DESCRIPTION

Various embodiments are directed to ergonomic guitar straps. In one embodiment, the ergonomic guitar strap includes a waist belt and at least a first strap and a second strap attachable to the waist belt. The first strap is adapted to be attached to a strap button located on the neck or body the guitar. The second strap is adapted to be attached to the heel button of the guitar. The ergonomic guitar strap allows a player to comfortably hold a guitar by off-loading at least a portion of the weight of the guitar to the hips of the player.

Figures 1A, 1B:
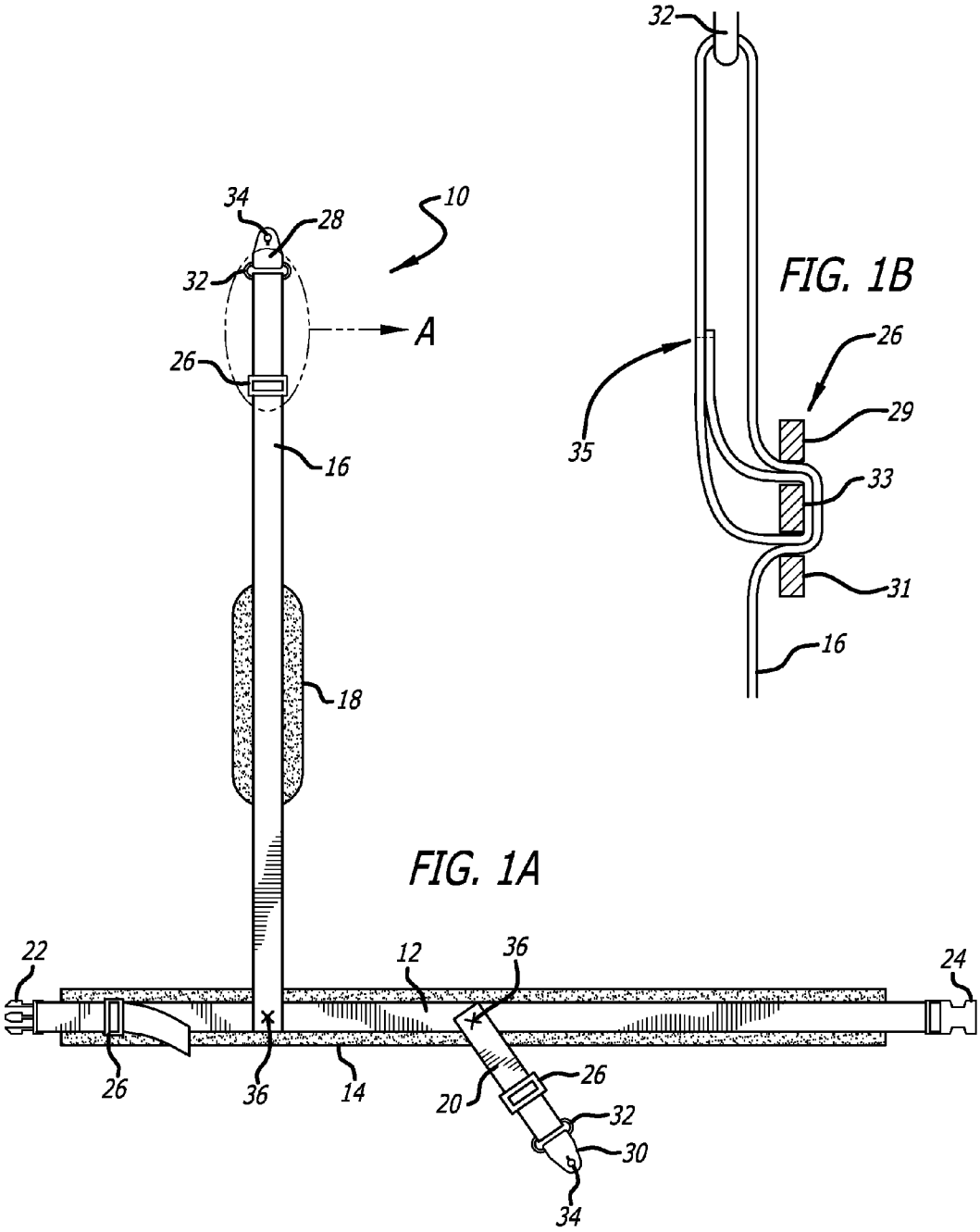
FIG. 1A is a plan view of one embodiment of an ergonomic guitar strap.
FIG. 1B is an enlarged side view of Detail A of FIG. 1A.

FIG. 1A is one embodiment of an ergonomic guitar strap 10 that allows a player to lay the shoulder strap over either shoulder for comfort and to relieve pressure on the player's neck and shoulder as compared to a traditional guitar strap. As shown in FIG. 1A, the ergonomic guitar strap 10 is composed of a waist belt 12, a shoulder belt 16, and heel strap 20. The shoulder strap 16 is a length of material that extends from the player's waist over either shoulder of the guitar player and attach to a portion of the guitar. One end of the shoulder belt 16 is attached to the waist belt 12 by stitching 36. The opposite end of the shoulder strap includes a strap end 28 adapted to be affixed to a strap button.

The heel strap 20 is a length of material that is attached to the waist belt 12 at one end by stitching 36. The heel strap 20 also includes a strap end 30 at the end opposite the attachment point to the waist belt 12. The strap end 30 is adapted to be affixed to the heel strap button at the base of the guitar body (not shown). As shown in FIG. 1A, the shoulder belt strap 16 and the heel strap 20 are attached to the waist belt 12 by stitching 36. It should be appreciated that other forms of permanently or reversibly attaching (i.e., attaching and detaching) the straps 16, 20 to the waist belt 12 are contemplated including, but not limited to, gluing, melting, riveting, clipping, buckling, snapping, attaching via Velcro or by other means of attaching two components together that is known or developed in the art.

As shown in FIG. 1A, each of the strap ends 28, 30 are attached to the shoulder and heel straps 16, 20 by a loop 32. Alternatively, the strap ends can be attached to other coupling means known or developed in the art. The coupling means can permanently or reversibly attach the strap ends to the shoulder and heel straps. In yet an alternate embodiment, the strap ends 28, 30 are directly attached to the shoulder 16 and heel 20 straps.

Figure 7:
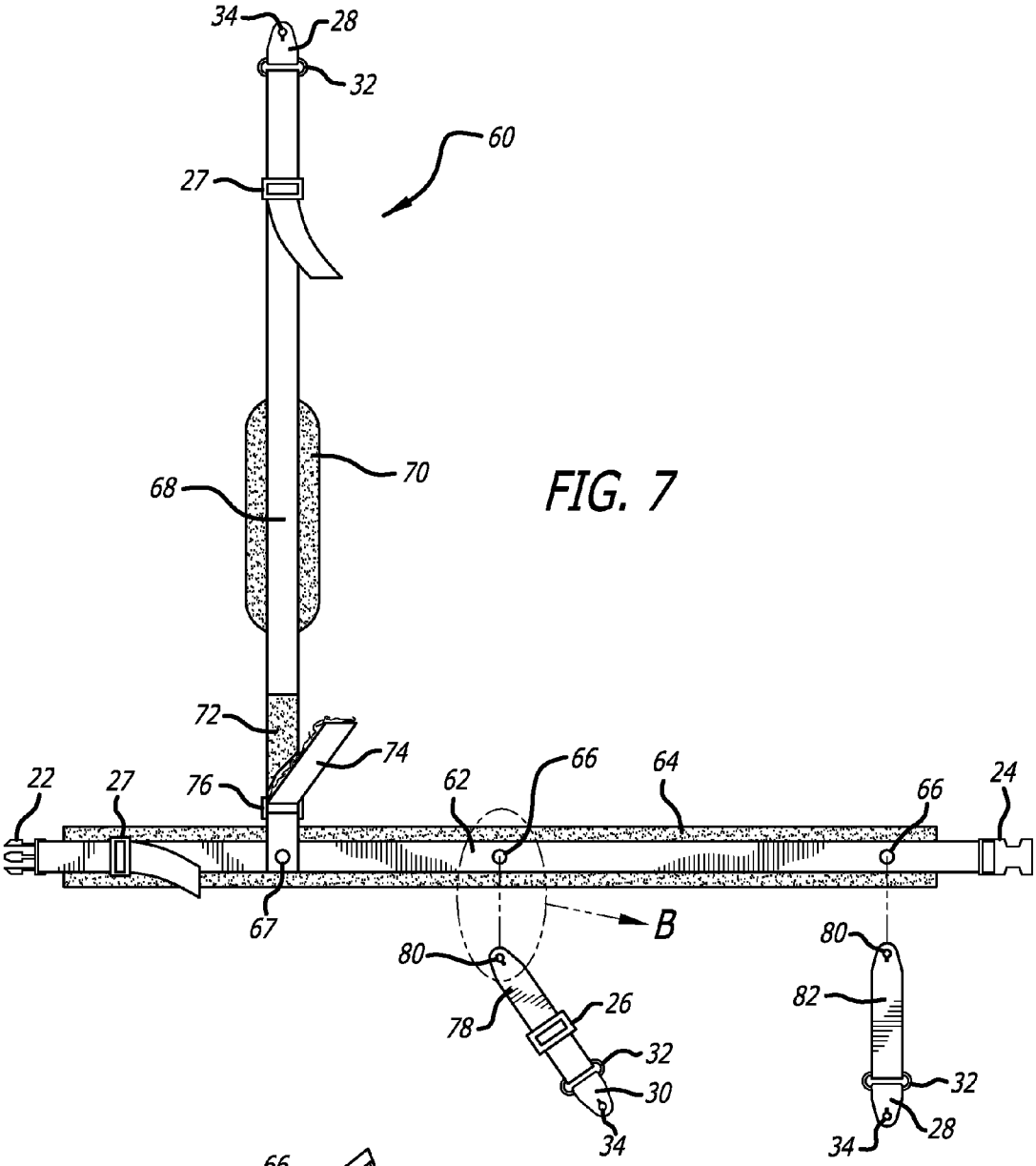
FIG. 7 is a plan view of yet another embodiment of an ergonomic guitar strap.

The waist belt 12, shoulder 16 and heel straps 20 each include a strap adjuster 26 so that the length of the straps may be adjusted as shown in FIGS. 1A-4. As shown in FIG. 1B, the strap adjuster 26 is a 3-bar slider. The strap adjuster 26 includes two outer bars 29, 31 and a center bar 33. According to the embodiment shown in FIG. 1B, the strap 16 is threaded below an outer bar 31, over the center bar 33, and then under the opposite outer bar 29. The strap 16 is then passed through a loop 32 and then passes under and around the center bar 33. The free end of the shoulder strap 16 is then secured to the shoulder strap itself at location 35 on the shoulder strap by stitching, gluing, melting, riveting, clipping, buckling, snapping, or by other means of attaching two components together known or developed in the art. By using the configuration of the strap 16 and strap adjuster 26 shown in FIGS. 1A-1B, an aesthetically pleasing strap 16 is provided. Additionally, there is no loose end of the strap to interfere with the guitar player when the ergonomic guitar strap 10 is worn and used by a guitar player. In an alternate embodiment, the strap 16 may be threaded through the adjuster 26 and a free end of the strap lies on top of the shoulder strap as shown in FIG. 7. As those skilled in the art will appreciate, other means for adjusting the strap length known or developed in the art are also contemplated.

Optionally, padding 14, 18 may be attached to the shoulder strap 16 and waist belt 12 as shown in FIG. 1A. The padding 14, 18 may be permanently or removably attached to the shoulder strap 16 and/or waist belt 12, respectively. As shown in FIG. 1A, the padding 14, 18 has a uniform width. In alternate embodiments, the padding may have variable widths. For example, the padding on the waist belt may be wider at the position that corresponds to the middle of the guitar player's back. Additionally, the padding can extend along a portion of or along the entire length of the strap or belt. By way of example, but not of limitation, padding 18 is provided along, a portion of the shoulder strap 16. Alternatively, the padding 14 may span the entire length of the strap (not shown) or waist belt 12.

As shown in FIG. 1A, the heel strap 20 is attached to the waist belt 12 at a spaced distance from the attachment point for the shoulder strap 16 on the waist belt. Additionally, the heel strap 20 is pointing downward relative to the waist belt 12 such that the strap end 30 is below the waist belt. The shoulder strap 16 is configured in an upward direction relative to the waist belt 12 in that the strap end 28 is above the waist belt when fully extended. In FIG. 1A, the shoulder strap 16 is positioned closer to the left side of the waist belt 12, and the heel strap 20 is positioned closer to the right side of the waist belt. This configuration shown in FIG. 1A is suited for a right-handed guitar player. For a left-handed guitar player, the positions of the shoulder strap 16 and heel strap would be swapped. The shoulder strap would be positioned closer to the right side of the waist belt (not shown), and the heel strap would be located closer to the left side of the waist belt (not shown).

In FIG. 1A, the waist belt 12 is a length of material that is length adjustable. At one end of the waist belt 12, the waist belt is looped over itself so that the length of the belt may be adjusted with a strap adjuster 26. In another embodiment, the waist belt 12 has a fixed overall length, but the length of the belt may be adjusted with a convention belt buckle (composed of D-ring or "8-ring" frame, center bar, and prong attached to the center bar or frame), hook-and-eye buckle, heel roller buckle, cinch buckle, jam lever, buckle, cam lever buckle, side squeeze buckle, or a side release buckle (like a buckle found on conventional seat belt).

Figure 2:
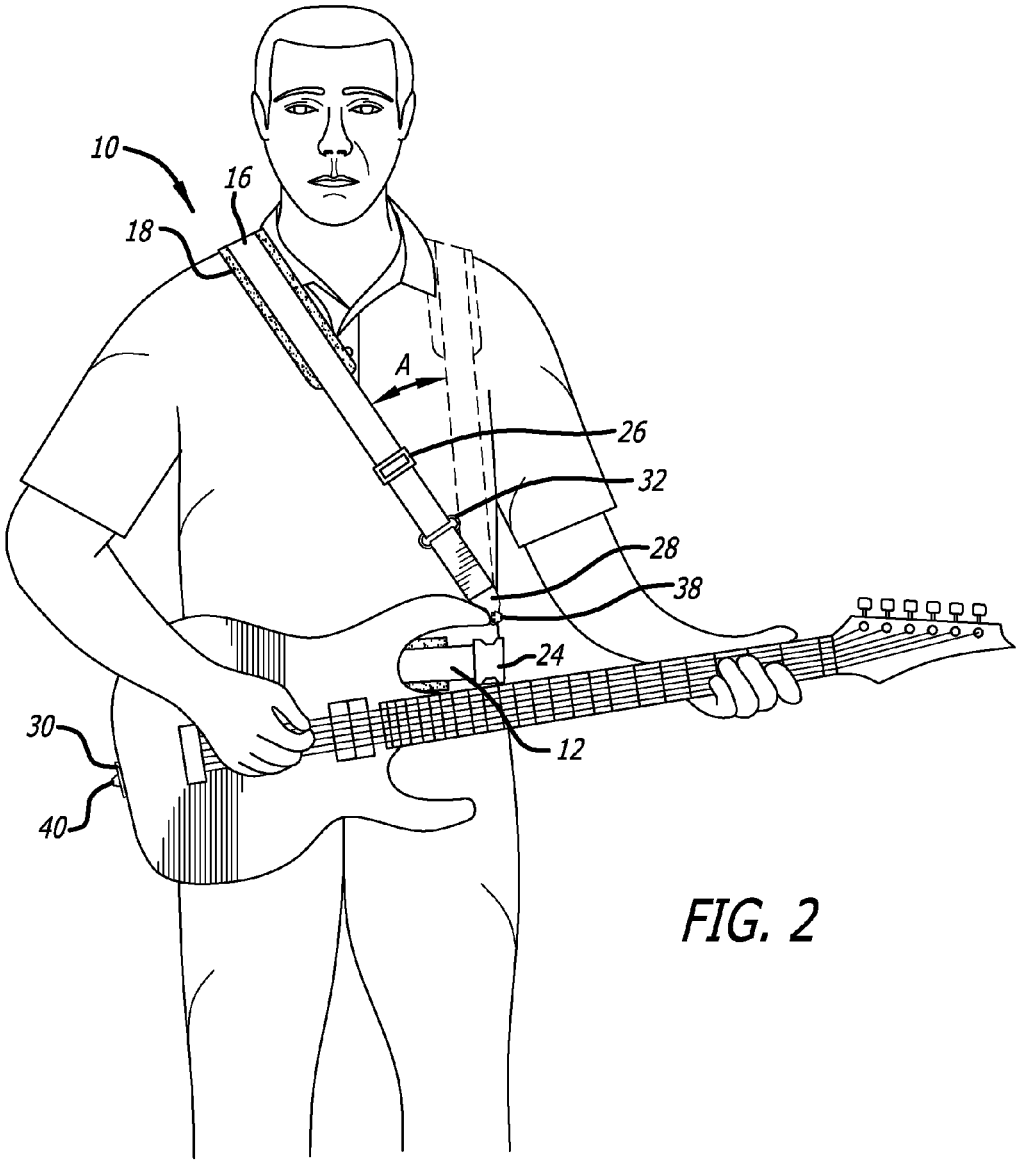
FIG. 2 is a front view of an individual using the ergonomic guitar strap of FIG. 1A.

FIG. 2 is a front view of a player using the ergonomic guitar strap 10 of FIG. 1A. As shown in FIG. 2, the shoulder strap 16 is attached to the horn strap button 38 on the guitar versus a neck strap button (not shown). The heel strap (not shown) is attached to the heel button. As shown in FIG. 2, the shoulder strap 16 is placed over the individual's right shoulder, but the shoulder strap can be placed on the left shoulder of the individual. Additionally, the buckle 24 of the waist belt 12 is positioned off-center relative to the player's body (i.e., near the hip). In an alternative embodiment, the buckle (not shown) is located at the mid-line (middle) of the waist belt.

Figure 3:
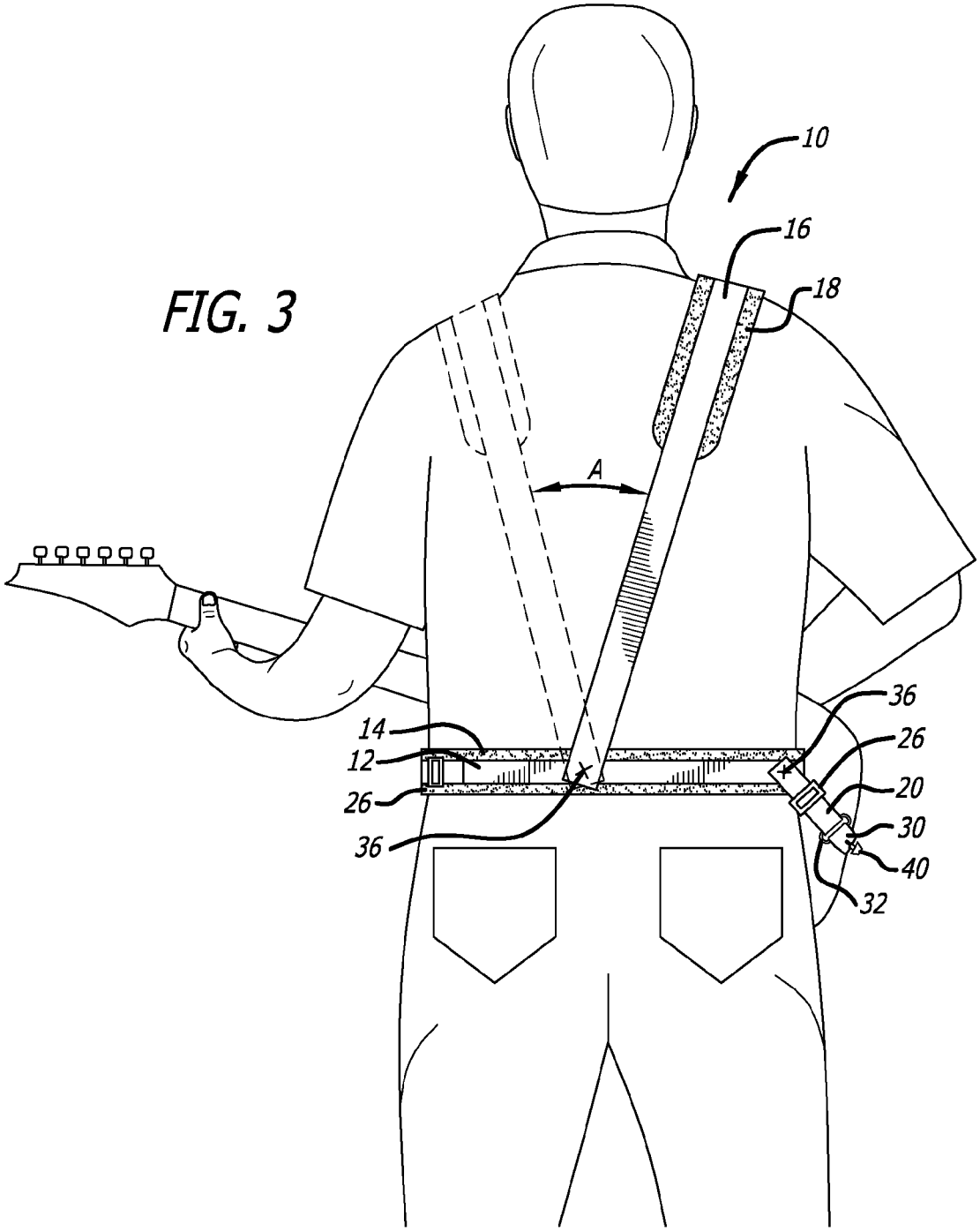
FIG. 3 is a back view of an individual using the ergonomic guitar strap of FIG. 1A.

FIG. 3 is a back view of the player using the ergonomic guitar strap 10 of FIG. 1A. Again, the shoulder strap 16 may be placed on either shoulder of the player. The ability to move the shoulder strap 16 from one shoulder to the other shoulder permits the player to find a comfortable playing position. Additionally, the strap adjuster 26 is shown on the left side of the waist belt 12. The shoulder strap 16, as shown in FIG. 3, is fixed to the waist belt 12 with stitching 36. As those skilled in the art will appreciate, the shoulder strap 16 may be fixed to the waist belt 12 by any means known or developed in the art FIG. 3 also shows the strap end 30 of the heel strap 20 attached to the heel strap button 40. The heel strap 20 includes a strap adjuster 26 that allows the heel strap to be adjustable in length. In an alternate embodiment, the heel strap (not shown) has a fixed length. In yet another embodiment, the shoulder strap (not shown) has a fixed length.

Figure 4:
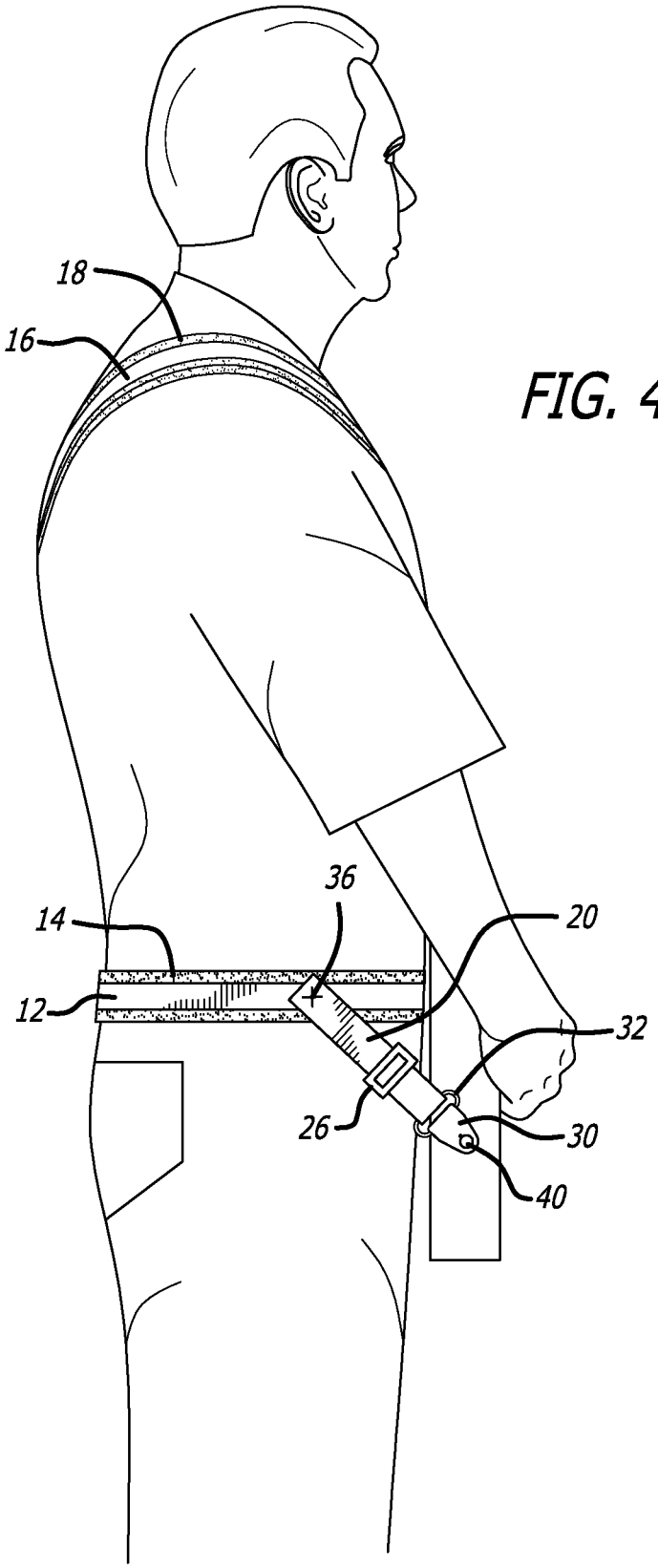
FIG. 4 is a side view of an individual using the ergonomic guitar strap of FIG. 1A.

FIG. 4 is a side view of the player using the ergonomic guitar strap 10 of FIG. 1. As shown in FIG. 4, the heel strap 20 is shown attached to the heel button 40 of the guitar. The heel strap 20 aids in off-loading the weight of the guitar from the player's shoulder and neck to the player's waist and hips.

Figure 5:
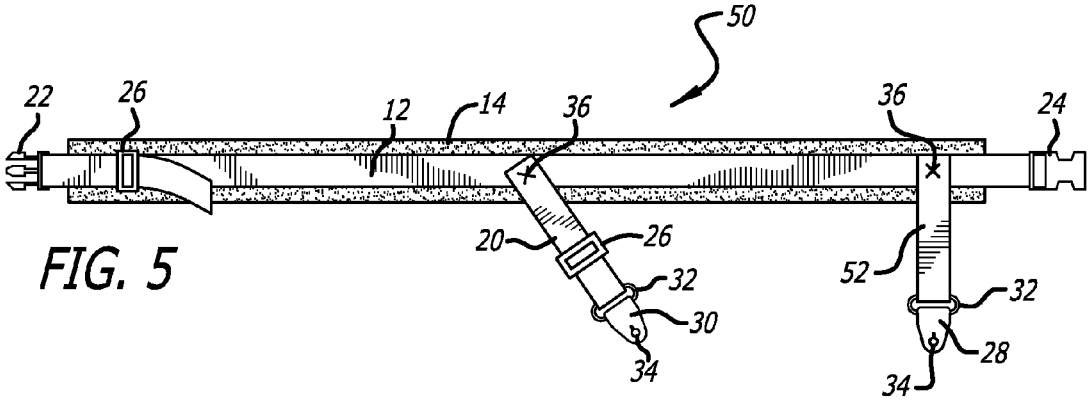
FIG. 5 is a plan view of another embodiment of an ergonomic guitar strap.
Figure 6:
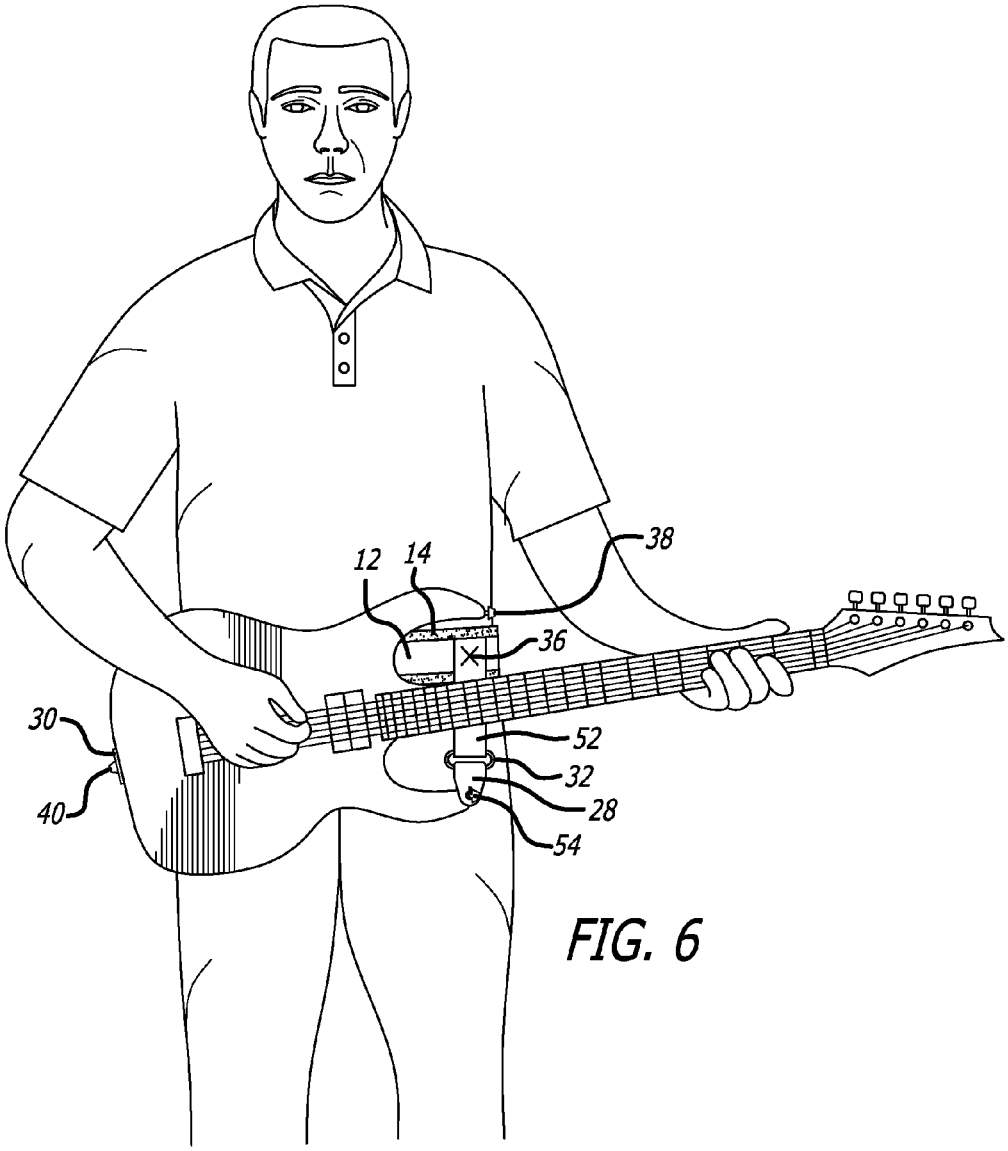
FIG. 6 is a front view of an individual using the ergonomic guitar strap of FIG. 5.

FIGS. 5-6 illustrates another embodiment of the ergonomic guitar strap 50 that includes a waist belt 12, heel strap 20, and horn strap 52. The ends of the waist belt 12 may be fastened together by a buckle 22, 24 or any means known or developed in the art to reversibly connect two parts together. As shown in FIG. 5, the waist belt 12 includes a strap adjuster 26 in order to adjust the length of the waist belt. In another embodiment, the waist belt (not shown) has a fixed length. The heel 20 and horn 52 straps are permanently attached to the waist belt 12. Alternatively, one or both of the straps 20, 52 may be removably attached to the waist belt 12 as shown in FIG. 7. The ends of the heel 20 and neck 52 straps include strap ends 30, 28, respectively, that are adapted to be attached to the heel and neck/horn buttons, respectively, on the guitar. As shown in FIGS. 5-6, the strap ends 30, 28 of the heel and neck straps 20, 52 are oriented in a downward direction relative to the waist belt 12. In an alternate embodiment, the neck strap 52 is oriented in an, upward direction relative to the waist belt 12. In this embodiment, the weight of the guitar is supported by the waist and hips of the guitar player.

As shown in FIG. 5, the waist belt 12 and the heel strap 20 are length-adjustable whereas the horn strap 52 has a fixed length. Alternatively, the heel strap (not shown) has a fixed length, and the horn strap (not shown) is adjustable in length as it includes a strap adjuster. In other embodiments, the heel and/or neck straps both may be length-adjustable or fixed length.

FIG. 6 shows a guitar player wearing the ergonomic guitar strap 50. The guitar strap 50 is worn around the waist of the individual. The heel strap 20 is attached to the heel button 40 of the guitar. The horn strap 52 hangs from the waist strap 12 such that the strap end 28 is adjacent to the lower horn, of the guitar. A horn button 54 is attached to the lower horn of the guitar as it is atypical to have a horn button provided on the lower horn (rather, the horn button 38 is typically found on the upper horn of the guitar). The strap end 28 is attached to the lower horn button 54. As shown in FIG. 6, the guitar player is right-handed and the neck/horn strap 52 is located, on the player's left side (from the player's perspective), and the heel strap 20 is located on the right side of the player (from the player's perspective). For a left-handed guitar player, the locations of the neck/horn strap and heel strap are as compared to the ergonomic guitar strap for a right-handed player. In other words, the neck/horn strap is located on the player's left side (from the player's perspective), and the heel strap is located on the right side of the ergonomic guitar strap (from the player's perspective).

FIG. 7 illustrates another embodiment of an ergonomic guitar strap 60. The guitar strap 60 includes a waist belt 62, shoulder strap 68, heel strap 78, and horn strap 82. In other embodiments, the guitar strap 60 may include only a shoulder strap 68 and heel strap 78. Alternatively, the guitar strap may include only a heel strap 78 and horn strap 82. As those skilled in the art will appreciate, since the straps are removable, the various straps may be added or removed depending upon the preferences of the guitar player. At one end of the shoulder strap 68, an adjuster 27 is provided to adjust the length of the shoulder strap. As shown in FIG. 7, the free end of the strap lies on top of the shoulder strap 68. In an alternate embodiment, the shoulder strap 68 may be adjustable using the configuration of the adjuster 26 and strap 16 of FIG. 1B.

As shown in FIG. 7, the shoulder strap 68 is reversibly attached to a loop 76 extending from the waist belt 62. As shown in FIG. 7, the shoulder strap 68 is provided with Velcro 72, 74 at one end, and the shoulder strap is attached to the waist belt 62 by threading the end of the shoulder strap through the strap loop 76 and coupling the Velcro together. In other embodiments, the shoulder strap may be reversibly attached to the waist belt by hook-and-eye buckle, side squeeze buckle, side release buckle, or other attachment means known or developed in the art.

As shown in FIG. 7, the shoulder strap 68 and waist belt 62 include padding 70, 64, respectively. The padding 64, 70 may be permanent or detachable padding. As those skilled in the art will appreciate, the padding may be added to one or more of the following: waist belt, heel strap, neck/horn strap, or shoulder strap in this embodiment or any other embodiments of the ergonomic guitar straps disclosed, herein.

Figure 8:
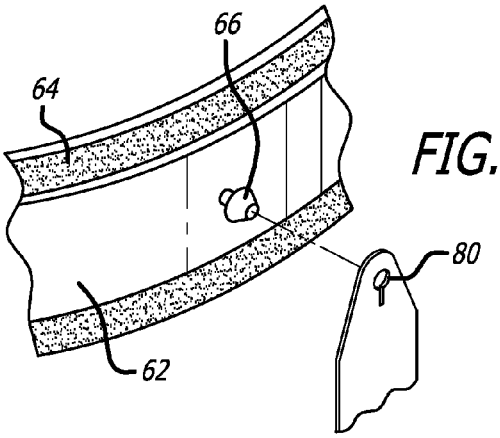
FIG. 8 is an enlarged view of Detail B of FIG. 7.

The ergonomic guitar strap 60 also includes studs 66 provided on the waist belt 62. The studs 66 allow the user to add, remove, or replace the heel strap 78 and horn strap 82. The heel and horn straps 78, 82 include openings 80 that are sized to fit over the studs 66 as shown in FIG. 8. While the shoulder strap 68 is also attached to the waist belt 62 by stitching 67, the shoulder belt can be attached via a stud 66 in an alternate embodiment. As shown in FIG. 7, the shoulder strap 68 and heel strap 78 include adjusters 27, 26 to change the lengths of the straps. In alternate embodiments, it is contemplated that the various straps (shoulder, heel, and/or horn) can be fixed-lengths and swapped out for differing lengths to fit a particular individual. By attaching the various straps to the waist belt via studs 66, the straps are able to rotate about the studs to provide additional flexibility and comfort to the player wearing the guitar strap 60.

Figure 9:
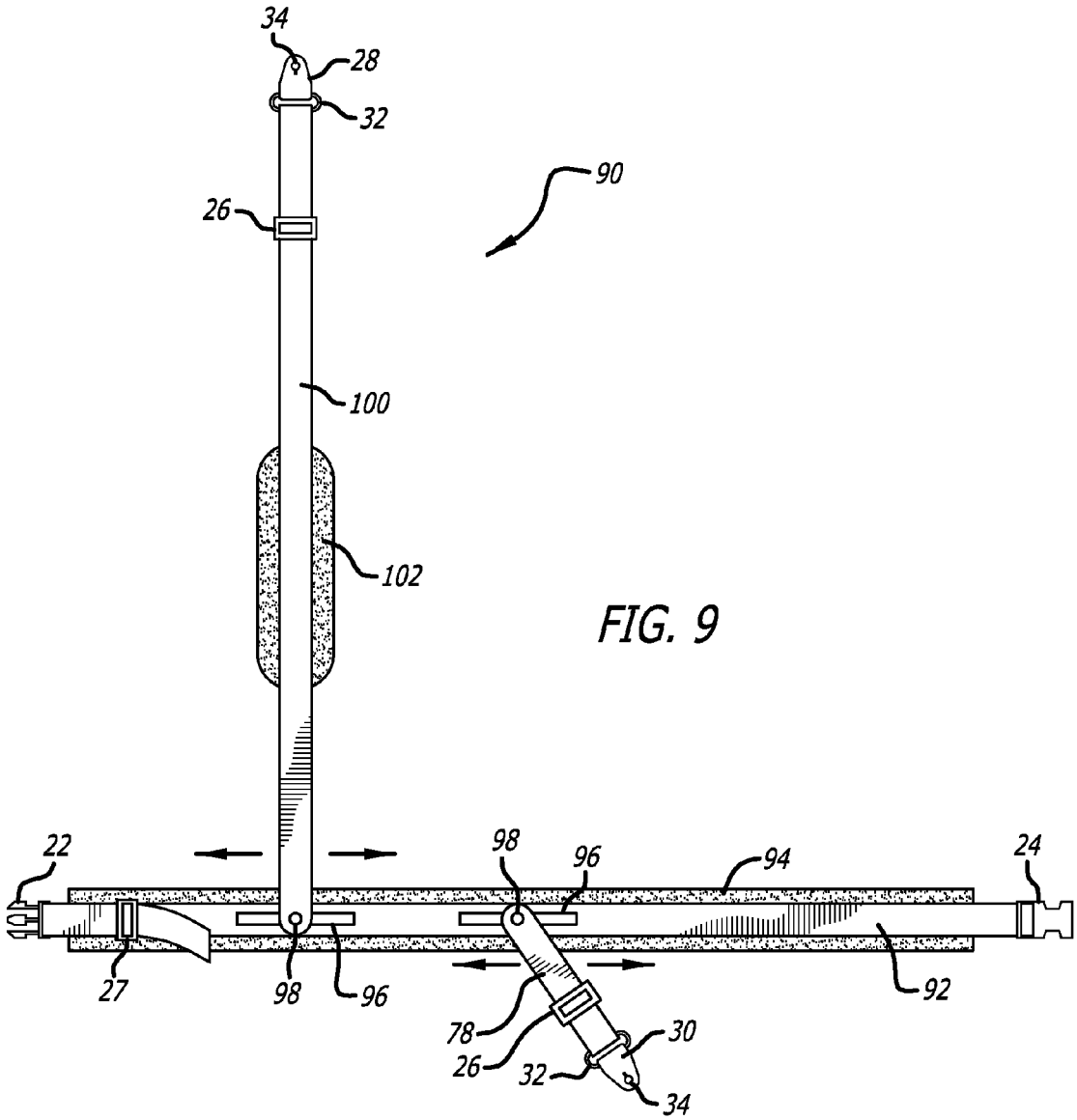
FIG. 9 is a plan view of yet another embodiment of an ergonomic guitar strap.

FIG. 9 illustrates another embodiment of an ergonomic guitar strap 90. The guitar strap 90 includes a waist belt 92, shoulder snap 100 and a heel strap 78. The waist belt 92 includes tracks 92 and posts 98 movable, along the tracks. The shoulder strap 100 and the heel strap 78 are attachable to the posts 98. As shown in FIG. 9, there are distinct tracks 92 for the shoulder and heel straps 100, 78. In an alternate embodiment, the waist belt 92 includes a single track (not shown) spanning along the length of the waist belt. The tracks allow the user to adjust the location of the shoulder strap 100 and the heel strap 78. In some embodiments, the shoulder straps and/or the heel strap are freely moveable along the tracks 96. In one embodiment, once the location of the shoulder and heel straps along the length of the waist belt is determined, these straps can be reversibly locked into position on the waist belt with a snap, clamp, screw, buckle, Velcro, or other fixing means known or developed in the art. In another embodiment, once the location of the adjustable shoulder and/or heel strap are determined, the straps may be permanently attached to the waist belt by stitching, rivets, or other fixing means known or developed in the art.

In other embodiments, the shoulder strap 100 may be swapped out for a horn strap 82. As those skilled in the art will appreciate, since the straps are removable, the various straps may be added or removed depending upon the preferences of the guitar player. Additionally, the shoulder and heel straps 100, 78 can pivot about the posts 98, which provides additional adjustability for the guitar player.

Figure 10:
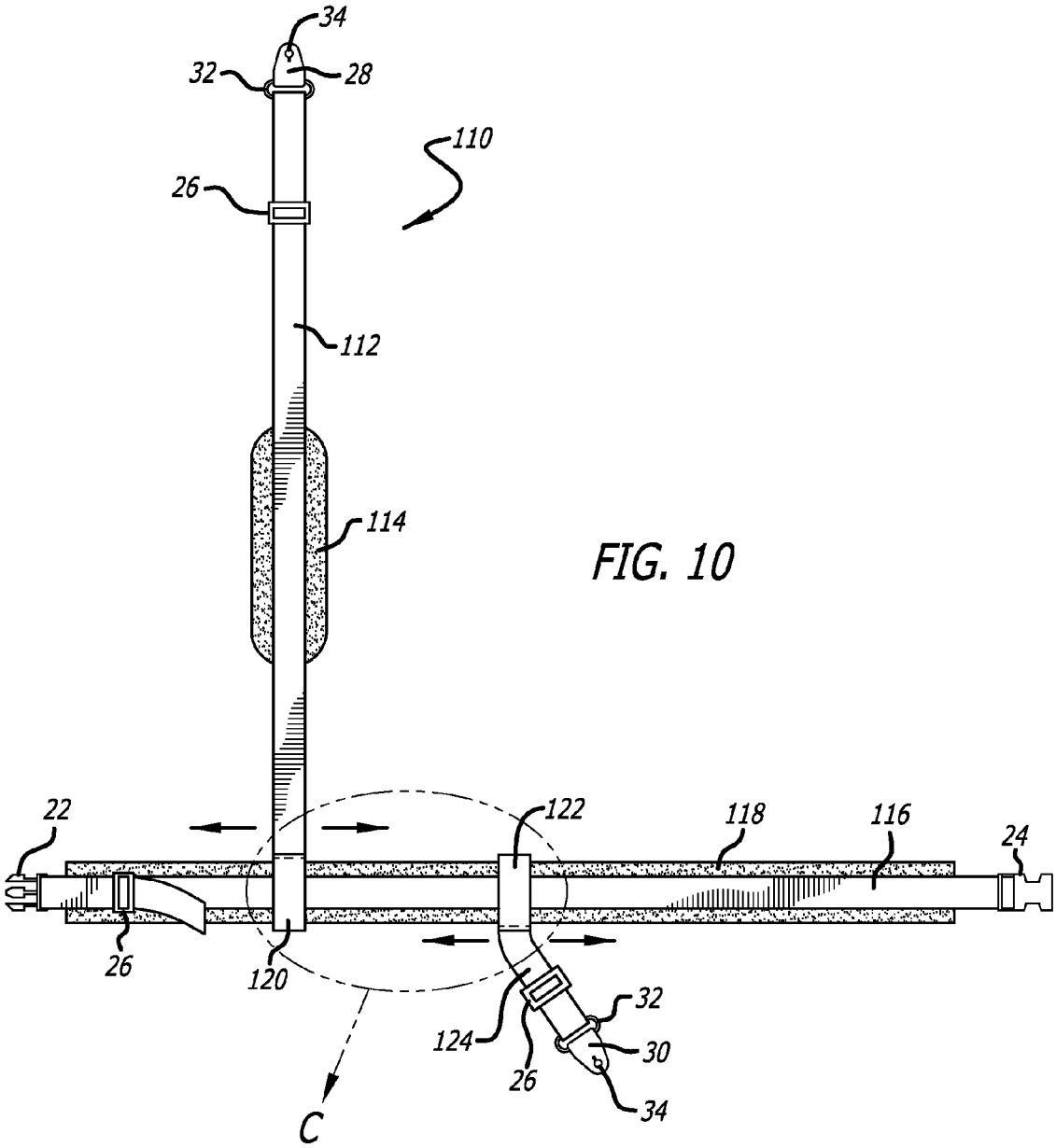
FIG. 10 is a plan view of another embodiment of an ergonomic guitar strap.
Figure 11:
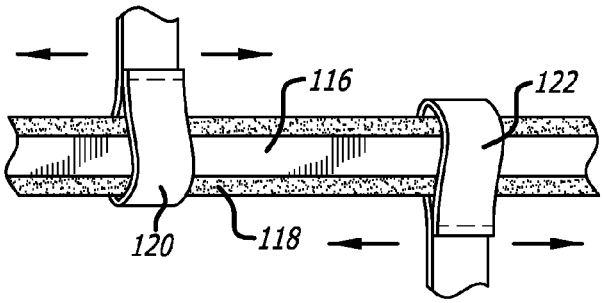
FIG. 11 is an enlarged view of Detail C of FIG. 10.

FIGS. 10-11 illustrate another embodiment of an ergonomic guitar strap 110 having a waist belt 116, a shoulder strap 112 and a heel strap 124. In this embodiment, the ends of the shoulder strap 112 and the heel strap 124 are formed in loops 120, 122. As shown in FIGS. 10-11, the loops 120, 122 are formed by folding the end of the strap onto itself. Alternatively, a pre-formed loop (not shown) may be attached to the end of the straps 112, 124. The waist belt 116 is then placed through the loops 120, 122 as shown in FIG. 11. In this embodiment, both the shoulder strap 112 and the heel strap 124 are movable along the length of the waist belt 116, which allows the player to adjust the location of the straps along the length of the waist belt. In another embodiment, the shoulder strap 112 is permanently attached to the waist belt 116 and the heel strap 124 is moveable. Alternatively, the shoulder strap 112 is moveable and the heel strap 124 is permanently attached to the waist strap 116.

The shoulder strap 112 and the heel strap 124 may be fixed length (not shown) or have adjusters 26 to alter the length of the straps. As shown in FIGS. 10-11, the heel strap 124 is angled relative to the waist belt in order to provide a better engagement with the heel button (not shown) on the guitar. Alternatively, the heel strap (not shown) can be a straight piece of material. In yet another embodiment, the waist belt 116 may be a traditional belt with the shoulder strap and the heel strap slidably attached or otherwise coupled to the traditional belt (by way of example, but not, of limitation, the straps may be clamped, stitched, or attached to the traditional belt by other means for attaching components together known or developed in the art). Once properly positioned, the shoulder strap and heel strap may be secured to the belt.

In addition to various embodiments of the ergonomic guitar straps, various methods are disclosed herein. According to one method, an ergonomic guitar strap is provided having a horn strap and heel strap attached to a waist belt. The guitar strap is worn around the waist of the player. In one method, the waist strap of the guitar is adjusted for length. The heel strap is then attached to a heel button on a base of the guitar. Optionally, the length of the heel strap is adjusted for length. The horn strap is attached to a lower horn button provided on a lower horn of the guitar. Additionally, as lower horn button is added to the lower horn of the guitar. Optionally, the length of the horn strap is adjusted for length.

In the various embodiments of the ergonomic guitar straps shown in FIGS. 1-11, the straps, the waist, shoulder, heel, and neck straps have a uniform width. Additionally as shown FIGS. 1-11, the straps are straight pieces of material. Alternatively, one or more of the straps can be curved or angled. In other embodiments, the straps have variable widths. Similarly, the ergonomic guitar straps may be made of nylon, polyester, polypropylene, leather, suede, cloth, elastomeric materials, or any other material known or developed in the art. The various straps (e.g., heel strap, shoulder strap, and neck/horn strap) may be permanently or removably attached to the waist belt. In those embodiments in which one or more of the straps are permanently attached to the waist belt, the ergonomic guitar straps may be configured in small, medium, large and extra large sizes for both youths and adults. In other embodiments, one or more of the straps may be adjustable in length. Additionally, padding may be permanently or removably attached to the one or more of the straps or waist belt.

The various embodiments described above are provided by way of illustration only and should not be construed to limit the disclosed invention. Those skilled in the art will readily recognize various modifications and changes that may be made to the disclosed invention without following the example embodiments and applications illustrated and described herein, and without departing from the true spirit and scope of the disclosed invention.

What is claimed:

1. A guitar strap for supporting a guitar without requiring a shoulder strap, the guitar having a heel strap button located at a base end of a guitar body and a horn strap button located on a lower horn of the guitar body, the guitar strap comprising:

a waist belt composed of a length of material having a first end and a second end, wherein the first end has a first fastening member and the second end having a second fastening member such that the first fastening member is reversibly coupled to the second fastening member;

a horn strap composed of a length of material having a first end and a second end, wherein the first end of the horn strap is coupled to the waist belt, and wherein the second end of the horn strap includes a strap end adapted to be affixed to the horn strap button located on the guitar body; and a heel strap composed of a length of material having a first end and a second end, wherein the first end of the heel strap is attached to the waist belt, and wherein the second end of the heel strap includes a strap end adapted to be affixed to a heel strap button located at a base end of the guitar body, wherein the second ends of the horn and heel straps are oriented below the waist belt.

2. The guitar strap of claim 1, wherein one or more of the waist belt, horn strap, or heel strap include padding along a portion of the waist belt, heel strap, and horn strap, respectively.

3. The guitar strap of claim 1, wherein the horn strap and the heel strap are reversibly attachable to the waist belt.

4. The guitar strap of claim 1, wherein the horn strap is coupled to a means for moving the horn strap along at least a portion of the length of the waist belt.

5. The guitar strap of claim 1, wherein the heel strap is coupled to a means for moving the heel strap along at least a portion of the length of the waist belt.

6. The guitar strap of claim 1, wherein the horn strap is pivotally coupled to the waist belt.

7. The guitar strap of claim 1, wherein the heel strap is pivotally coupled to the waist belt.

8. A method for allowing a player to play a guitar without the use of a shoulder strap, the method comprising:

providing a guitar strap that does not have a shoulder strap, the guitar strap including:

a waist belt;

a horn strap coupled to the waist belt at a first end of the horn strap, and a second end of the horn strap includes a strap end adapted to be affixed to a strap button or located on a guitar neck or an end of a guitar body; and a heel strap coupled to the waist belt at a first end of the heel strap, and a second end of the heel strap includes a strap end adapted to be affixed a strap button located at a base of the guitar body;

wearing the guitar strap around the waist of the player;

attaching the heel strap to a heel button provided on a base end of the guitar; and attaching the horn strap to a lower horn button provided on a lower horn of the guitar.

9. The method of claim 8, further comprising:

adjusting a length of the heel strap and the horn strap.

* * * * *